US010490067B2

(12) United States Patent
Li

(10) Patent No.: US 10,490,067 B2
(45) Date of Patent: Nov. 26, 2019

(54) SYSTEM AND METHOD FOR TRAFFIC REDIRECTION

(71) Applicant: BOE TECHNOLOGY GROUP CO., LTD., Beijing (CN)

(72) Inventor: Wenbo Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 159 days.

(21) Appl. No.: 15/532,460

(22) PCT Filed: Dec. 12, 2016

(86) PCT No.: PCT/CN2016/109491
§ 371 (c)(1),
(2) Date: Jun. 1, 2017

(87) PCT Pub. No.: WO2017/215210
PCT Pub. Date: Dec. 21, 2017

(65) Prior Publication Data

US 2018/0365987 A1 Dec. 20, 2018

(30) Foreign Application Priority Data

Jun. 17, 2016 (CN) ..... 2016 1 0440354

(51) Int. Cl.
*G08G 1/14* (2006.01)
*G08G 1/01* (2006.01)
(Continued)

(52) U.S. Cl.
CPC ..... *G08G 1/0145* (2013.01); *G08G 1/012* (2013.01); *G08G 1/0112* (2013.01);
(Continued)

(58) Field of Classification Search
CPC .. G08G 1/0145; G08G 1/0112; G08G 1/0116; G08G 1/012; G08G 1/0141
(Continued)

(56) References Cited

U.S. PATENT DOCUMENTS 8,949,016 B1 * 2/2015 Ferguson ..... B60W 30/00 340/436
8,954,217 B1 * 2/2015 Montemerlo ..... B60W 30/00 701/26
(Continued)

FOREIGN PATENT DOCUMENTS

CN 1952264 A 4/2007
CN 102063794 A 5/2011
(Continued)

OTHER PUBLICATIONS

International Search Report and Written Opinion dated Mar. 23, 2017 in PCT/CN2016/109491.
(Continued)

*Primary Examiner* — Thomas G Black
*Assistant Examiner* — Wae L Louie
(74) *Attorney, Agent, or Firm* — Syncoda LLC; Feng Ma

(57) ABSTRACT

The present disclosure provides a system and a method for traffic redirection upon congestion occurring on a road. The system for redirecting traffic on a road comprises a server and at least one traffic redirection device. Each of the at least one traffic redirection device is disposed along the road and is coupled with the server. The server is configured to receive congestion site information if a congestion occurs on the road, to determine a separation zone covering a location of congestion based on the congestion site information, to determine a redirected traffic pattern, and to send a traffic redirection instruction to the at least one traffic redirection device. The at least one traffic redirection device is config-
(Continued)

ured to respond to the traffic redirection instruction, such that the at least one traffic redirection device together displays the redirected traffic pattern on the road to thereby guide vehicles to bypass the separation zone.

20 Claims, 9 Drawing Sheets

(51) Int. Cl.
*G08G 1/095* (2006.01)
*G08G 1/0967* (2006.01)

(52) U.S. Cl.
CPC ..... *G08G 1/0116* (2013.01); *G08G 1/0133* (2013.01); *G08G 1/0141* (2013.01); *G08G 1/095* (2013.01); *G08G 1/0967* (2013.01); *G08G 1/096716* (2013.01); *G08G 1/096741* (2013.01); *G08G 1/096775* (2013.01)

(58) Field of Classification Search
USPC ..... 701/118
See application file for complete search history.

(56) References Cited

U.S. PATENT DOCUMENTS 8,954,261 B2 * 2/2015 Das ..... G08G 1/163 342/457
9,805,595 B1 * 10/2017 Liebinger Portela ..... G08G 1/0145
9,869,560 B2 * 1/2018 Gordon ..... B60W 30/00
2004/0130463 A1 * 7/2004 Bloomquist ..... G08G 1/096716 340/907
2008/0207200 A1 * 8/2008 Fein ..... H04B 1/38 455/426.1
2014/0278052 A1 * 9/2014 Slavin ..... G01C 21/3492 701/400
2014/0309789 A1 * 10/2014 Ricci ..... B60Q 1/00 700/276
2014/0309806 A1 * 10/2014 Ricci ..... B60Q 1/00 701/1
2014/0309864 A1 * 10/2014 Ricci ..... H04W 4/21 701/36
2014/0330479 A1 * 11/2014 Dolgov ..... B60W 30/16 701/28
2016/0366632 A1 * 12/2016 Cui ..... H04W 40/04
2017/0054641 A1 * 2/2017 Anerousis ..... H04W 24/08
2017/0070387 A1 * 3/2017 Rao ..... H04L 41/0816
2018/0365987 A1 * 12/2018 Li ..... G08G 1/0133

FOREIGN PATENT DOCUMENTS

CN 202306832 U 7/2012
CN 104464319 A 3/2015
CN 104778847 A 7/2015

OTHER PUBLICATIONS

Chinese Office Action dated Feb. 5, 2018 in corresponding Chinese application No. 201610440354.7.

* cited by examiner

SYSTEM AND METHOD FOR TRAFFIC REDIRECTION

CROSS-REFERENCE TO RELATED APPLICATION

The present application claims priority to Chinese Patent Application No. 201610440354.7 filed on Jun. 17, 2016, the disclosure of which is hereby incorporated by reference in its entirety.

TECHNICAL FIELD

The present disclosure is related generally to the technologies of internet of things, and more specifically to a system and a method for traffic redirection upon congestion occurring on a road.

BACKGROUND

Currently an increasingly large number of cars and vehicles moving on the roads has imposed a large burden on the traffic. As a result, traffic jams frequently occur on the roads, especially on the major road with crossings and/or during rush hours and holidays.

This is especially the case when a traffic accident happens, when the drivers implicated in the traffic accident typically choose to wait on site until the police arrives to handle the traffic accident and to redirect the traffic. This often causes the scene of the traffic accident unable to be cleared in time, which in turn results in a congestion of the traffic at the segment of the road where the traffic accident happens.

SUMMARY

The present disclosure provides a system and a method for redirecting traffic (i.e. adjusting traffic lanes) on the road after a traffic accident occurs, which allows the traffic lanes to be adjusted quickly, such that the location of the traffic accident can be intelligently bypassed to allow an effective redirection of the traffic to effectively relieve the issue of traffic accident-induced road congestion.

In a first aspect, the present disclosure provides a system for redirecting traffic on a road. The system comprises a server and at least one traffic redirection device. Each of the at least one traffic redirection device is disposed along the road and is coupled with the server.

The server is configured to receive congestion site information if a congestion occurs on the road, to determine a separation zone covering a location of congestion based on the congestion site information, to determine a redirected traffic pattern, and to send a traffic redirection instruction to the at least one traffic redirection device. The at least one traffic redirection device is configured to respond to the traffic redirection instruction, such that the at least one traffic redirection device together displays the redirected traffic pattern on the road to thereby guide vehicles to bypass the separation zone.

In the system as described above, the road can include at least one traffic lane, the congestion site information can include a status of each of the at least one traffic lane around the location of congestion, and the redirected traffic pattern can include at least one adjusted traffic lane, wherein each of the at least one adjusted traffic lane is adjusted from a corresponding traffic lane and configured to bypass the separation zone.

In the system as described above, the at least one traffic lane can comprise a first lane and at least one second lane, wherein the congestion occurs on the first lane, and each of the at least one second lane is adjacent to the first lane. The redirected traffic pattern can comprise an adjusted first lane and at least one adjusted second lane.

The adjusted first lane is adjusted on a section of the first lane having the separation zone and is configured such that a distance between at least one sideline thereof and an opposing sideline of the separation zone is at least a width substantially allowing an ordinary vehicle to pass by. Each of the at least one adjusted second lane is adjusted from a corresponding second lane and is configured to be substantially in parallel with the adjusted first lane and have a width substantially allowing an ordinary vehicle to pass by.

In some embodiments of the system disclosed herein, the road can further comprise an emergency lane, and the at least one traffic lane can comprise a third lane and at least one fourth lane, wherein the congestion occurs on the third lane, and the at least one fourth lane is between the third lane and the emergency lane. The congestion site information can further comprise a status of the emergency lane around the location of congestion. The redirected traffic pattern comprises an adjusted third lane and at least one adjusted fourth lane.

The adjusted third lane is widened on a section of the third lane having the separation zone such that a sideline thereof between the separation zone and the emergency lane bends towards the emergency lane to substantially allow an ordinary vehicle to pass by. Each of the at least one adjusted fourth lane is adjusted from a corresponding fourth lane and is configured to substantially bend towards the emergency lane to substantially allow an ordinary vehicle to pass by.

In some embodiments of the system disclosed herein, the at least one traffic redirection device can include a plurality of light sources, which are disposed over a surface of the road and arranged in a matrix. Each of the plurality of light sources is configured to switch on or off under control of the server.

The traffic redirection instruction can comprise an ON signal or an OFF signal, which are respectively configured to control turning-on or turning-off of each of a subset of the plurality of light sources around the location of congestion. Each of the subset of the plurality of light sources is configured to switch on or off upon receiving the traffic redirection instruction from the server, such that the subset of the plurality of light sources together mark bounds of each of the at least one adjusted traffic lane to thereby display the redirected traffic pattern on the road.

In some embodiments of the system disclosed herein, the at least one traffic redirection device can comprise a plurality of projection lamps, which are disposed along the road. Each of the plurality of projection lamps is configured to project a light onto a surface of the road under control of the server.

The traffic redirection instruction can comprise a first specification for an angle and a second specification for a pattern for each of a subset of the plurality of projection lamps around the location of congestion. Each of the subset of the plurality of projection lamps is configured to project a light at the angle and the pattern specified by the traffic redirection instruction, such that the subset of the plurality of projection lamps together mark bounds of each of the at least one adjusted traffic lane to thereby display the redirected traffic pattern on the road.

In some embodiments of the system disclosed herein, the at least one traffic redirection device can comprise a plurality of traffic instruction displaying devices, which are disposed along the road.

The traffic redirection instruction can comprise information of the redirected traffic pattern and is configured to be sent to each of a subset of the plurality of traffic instruction displaying devices around the location of congestion; and each of the subset of the plurality of traffic instruction displaying devices is configured to display the information of the redirected traffic pattern.

According to some embodiments of the present disclosure, the system further includes at least one congestion site notification device. Each congestion site notification device is coupled with the server and is configured to notify the server of a location of each of the at least one congestion site notification device upon triggering by a person close to the location of congestion. The congestion site information received by the server comprises the location of each of the at least one congestion site notification device.

The at least one congestion site notification device comprises at least one of a triggering device or an electronic device. The triggering device is disposed along the road and is configured to send to the server a location of the triggering device upon triggering. The electronic device is configured to send to the server a location of the electronic device upon triggering.

In the above, the triggering device can be disposed on one of the at least one traffic redirection device and as such is configured to send to the server a location of the one of the at least one traffic redirection device upon triggering. The electronic device can be a mobile phone, a vehicle-mounted device, or a computer.

According to some embodiments of the present disclosure, the system can further include at least one camera, which is disposed along the road. Each of the at least one camera is coupled with the server, and is configured to notify the server of a status of traffic around the location of congestion upon activation by the server receiving the congestion site information. The congestion site information can further include the status of traffic around the location of congestion.

In the system as described above, the server can be configured to determine the separation zone based on the status of traffic around the location of congestion.

In some embodiments of the system disclosed herein, the server is configured to determine the separation zone further based on a maximum speed limit at the location of congestion on the road, wherein a size of the separation zone is configured to be proportional to the maximum speed limit at the location of congestion on the road.

In the system disclosed herein, the server can include a receiving portion, a determination portion, a traffic lane adjustment portion, and a traffic redirection portion.

The receiving portion is configured to receive the congestion site information if a congestion occurs on the road. The determination portion is configured to determine the separation zone comprising the location of congestion based on the congestion site information. The traffic lane adjustment portion is configured to determine the redirected traffic pattern based on the separation zone. The traffic redirection portion is configured to generate, and to send to each of the subset of the at least one traffic redirection device around the location of congestion, the traffic redirection instruction based on the redirected traffic pattern.

In the system disclosed herein, the server can be a cloud server, a surveillance server, or a remote controller.

In a second aspect, the present disclosure provides a method for redirecting traffic on a road by means of a traffic redirection system as described above. The method comprises the following steps:

the server receiving congestion site information if a congestion occurs on the road;

the server determining a separation zone covering a location of congestion based on the congestion site information;

the server determining a redirected traffic pattern based on the separation zone;

the server generating a traffic redirection instruction based on the redirected traffic pattern and sending the redirected traffic pattern to the at least one traffic redirection device; and the at least one traffic redirection device displaying the redirected traffic pattern on the road to thereby guide vehicles to bypass the separation zone.

According to some embodiments of the method disclosed herein, the server receiving congestion site information if a congestion occurs on the road can comprise:

one of at least one congestion site notification device disposed along the road notifying the server of a location of the one of the at least one congestion site notification device upon triggering by a person close to the location of congestion, wherein the congestion site information received by the server comprises the location of each of the at least one congestion site notification device.

According to some embodiments of the method disclosed herein, after one of at least one congestion site notification device notifying the server of a location of the one of the at least one congestion site notification device upon triggering by a person close to the location of congestion, the server receiving congestion site information if a congestion occurs on the road can further comprise:

one of at least one camera disposed along the road notifying the server of a status of traffic around the location of congestion upon activation by the server receiving the location of the one of the at least one congestion site notification device, wherein the congestion site information further comprises the status of traffic around the location of congestion.

In the method as described above, the separation zone can be determined further based on a maximum speed limit at the location of congestion on the road, such that a size of the separation zone is configured to be proportional to the maximum speed limit at the location of congestion.

Here in the disclosure, an ordinary vehicle refers to a vehicle that moves on one typical traffic lane on a typical road, and may include a car, a truck, a bus, and all other vehicles having a regular width. There are no limitations herein.

Other embodiments may become apparent in view of the following descriptions and the attached drawings.

BRIEF DESCRIPTION OF THE DRAWINGS

To more clearly illustrate some of the embodiments, the following is a brief description of the drawings. The drawings in the following descriptions are only illustrative of some embodiments. For those of ordinary skill in the art, other drawings of other embodiments can become apparent based on these drawings.

DETAILED DESCRIPTION

In the following, with reference to the drawings of various embodiments as disclosed herein, the technical solutions of the embodiments of the disclosure will be described in a clear and fully understandable way.

It is obvious that the described embodiments are merely a portion but not all of the embodiments of the disclosure. Based on the described embodiments of the disclosure, those ordinarily skilled in the art can obtain other embodiment(s), which come(s) within the scope sought for protection by the disclosure.

Figure 1:
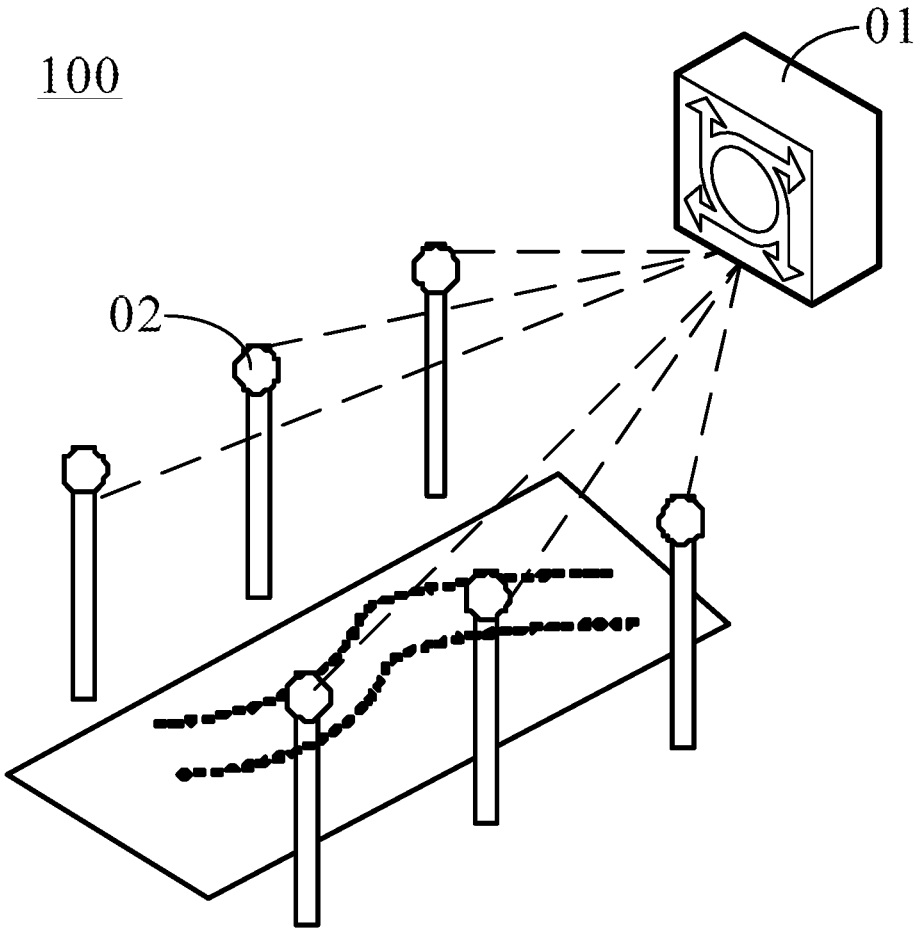
FIG. 1 is a schematic diagram of a traffic redirection system according to some embodiments of the present disclosure.

FIG. 1 is a schematic diagram of a traffic redirection system according to some embodiments of the present disclosure. The traffic redirection system 100 comprises a server 01, and at least one traffic redirection device 02. The server 01 can be a cloud server, a surveillance server, or a remote controller, and is configured to couple with, and thereby allowing a communication with, each of the at least one traffic redirection device 02 through a wireless or wired manner.

Specifically, the server 01 can obtain congestion site information, including information about a location of congestion, and information about the traffic (i.e. statuses of traffic lanes or driving lanes) around the location of congestion. Next based on the location of congestion, the server 01 can determine a separation zone, which is configured to separate or isolate the location of congestion from the traffic on the road. Then based on the separation zone, the server 01 can determine a redirected traffic pattern comprising at least one adjusted traffic lane, which is configured to redirect or adjust the traffic (i.e. the traffic lanes) such that the redirected traffic (i.e. the adjusted traffic lanes) can each bypass the separation zone.

After that, the server 01 can generate a traffic redirection instruction based on the redirected traffic pattern, and then the server 01 can send the traffic redirection instruction to the at least one traffic redirection device 02, which can then display the redirected traffic pattern on the road.

As such, cars and vehicles can move following the redirected traffic pattern (i.e. moving along the redirected traffic lanes) displayed by the at least one traffic redirection device 02, to thereby bypass the separation zone. Consequently, the location of congestion can be bypassed, thereby resulting in an intelligent traffic redirection and an effective reduction of traffic jams caused by traffic accidents.

The at least one traffic redirection device 02 can comprise a plurality of light sources aligned in a matrix on the surface of the road, and as such, the bounds of each of the redirected traffic lanes can be determined by lights emitted from each of the plurality of light sources.

Alternatively, the at least one traffic redirection device 02 can comprise a plurality of projection lamps, configured to each project or emit light on the surface of the road, and as such, the bounds of each of the redirected traffic lanes can be determined by lights projected from each of the plurality of projection lamps.

Or alternatively, the at least one traffic redirection device 02 can comprise a plurality of traffic instruction displaying devices (such as electric road signs), and as such, information of the redirected traffic lanes can be displayed on a display panel of each of the plurality of traffic instruction displaying devices.

Figure 2:
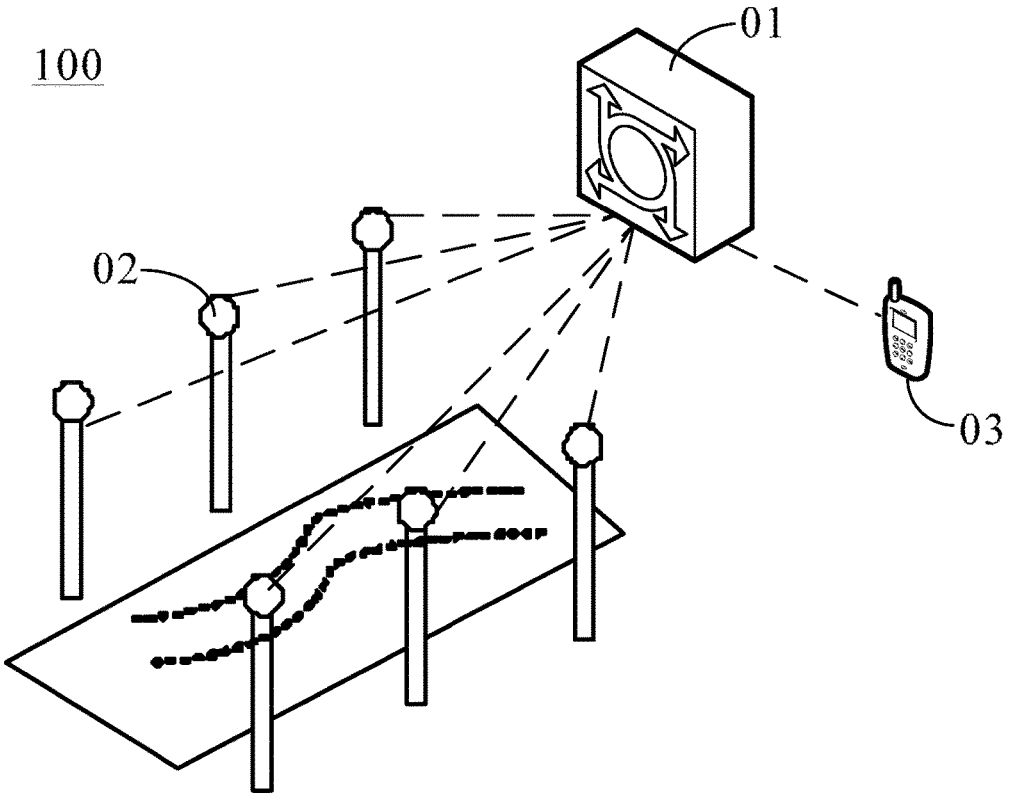
FIG. 2 is a schematic diagram of a traffic redirection system according to some other embodiments of the present disclosure.

In some embodiments of the present disclosure, the traffic redirection system 100 can further comprise at least one electronic device 03 as illustrated in FIG. 2. Each of the at least one electronic device 03 is configured to couple with, and thereby capable of communicating with, the server 01. Each of the at least one electronic device 03 can be a mobile phone, a vehicle-mounted device, a computer, etc., and there are no limitations herein.

Each of the at least one electronic device 03 is configured to send to the server 01 the location of congestion, such that upon receiving the location of congestion, the server 01 can determine the separation zone for separating the location of congestion from the traffic on the road.

Figure 3:
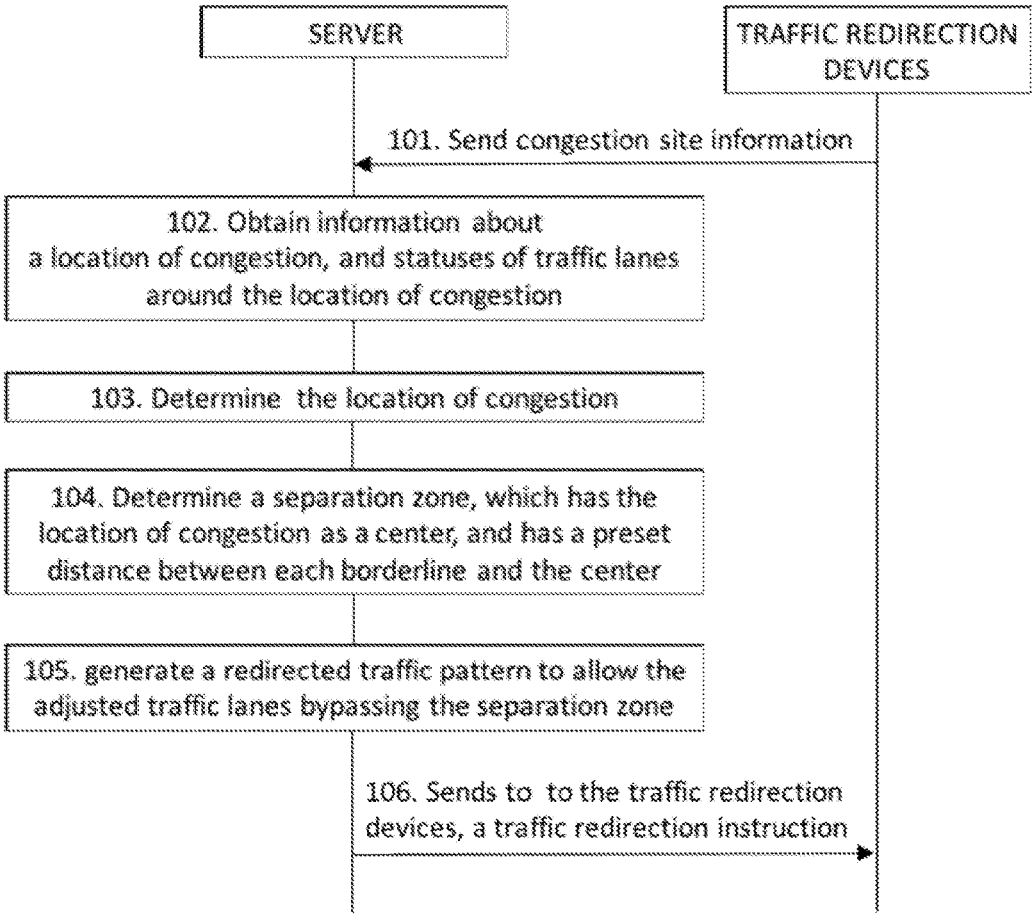
FIG. 3 illustrates a sketch of a method for traffic redirection applying the traffic redirection system according to some embodiments of the present disclosure.

FIG. 3 illustrates a sketch of a traffic redirection method applying the traffic redirection system 100 as described above according to some embodiments of the present disclosure. The method comprises the following steps:

(101) upon congestion, at least one traffic redirection device and/or at least one electronic device can send congestion site information to a server;

(102) the server obtains the congestion site information and statuses of traffic lanes around the location of congestion;

(103) the server determines the location of congestion based on the congestion site information;

(104) the server determines a separation zone, wherein the separation zone has the location of congestion as a center, and has a preset distance between each of the borderlines and the center;

(105) the server adjusts the traffic lanes to generate a redirected traffic pattern comprising at least one adjusted traffic lane, wherein each of the at least one adjusted traffic lane bypasses the separation zone;

(106) based on the redirected traffic pattern, the server generates a traffic redirection instruction, and then sends the traffic redirection instruction to the at least one traffic redirection device 02 for displaying the redirected traffic pattern on the road.

Differing from current technologies employing paints to mark bounds of each of the traffic lanes on the road, the traffic redirection method as described above can utilize at least one traffic redirection device in a traffic redirection system for marking the bounds of each of the traffic lanes on the road in a flexible, configurable manner.

Figure 4:
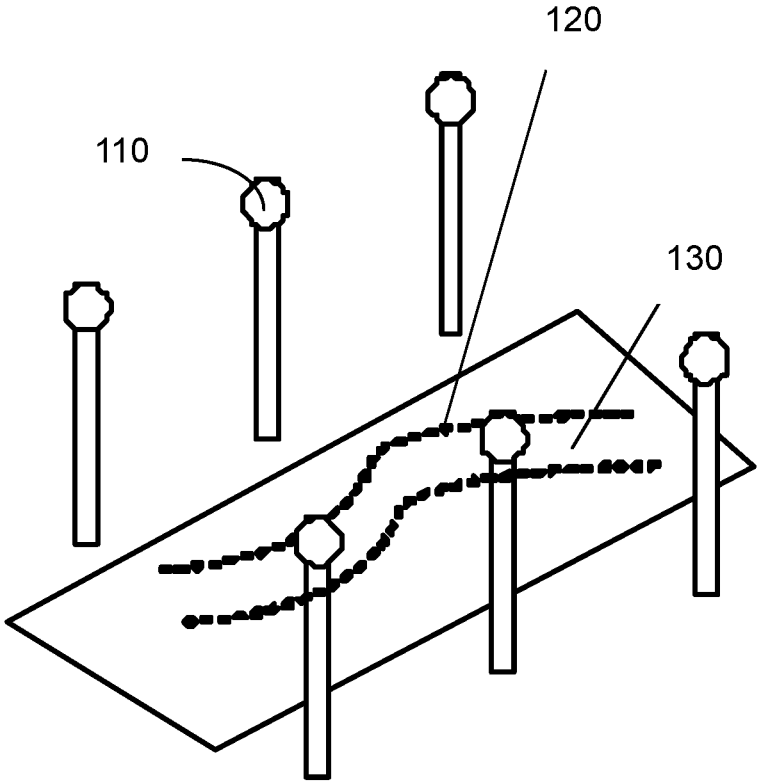
FIG. 4 illustrates a working principle of a first type of a traffic redirection device in a traffic redirection system according to some embodiments of the present disclosure.

For example, in a first embodiment of the present disclosure, a plurality of projection lamps 110 can be arranged on either one side or both sides of the road and are configured to serve as the at least one traffic redirection device in the traffic redirection system, as illustrated in FIG. 4. By adjusting angles and patterns of a light emitted from each of the plurality of projection lamps 110, a corresponding pattern can be displayed on different positions of the road to thereby mark the bounds 120 of each of the traffic lanes 130. Thus by altering the angles and the patterns of the lights emitted from the plurality of projection lamps 110, the traffic lanes 130 on the road can be altered conveniently.

Figure 5:
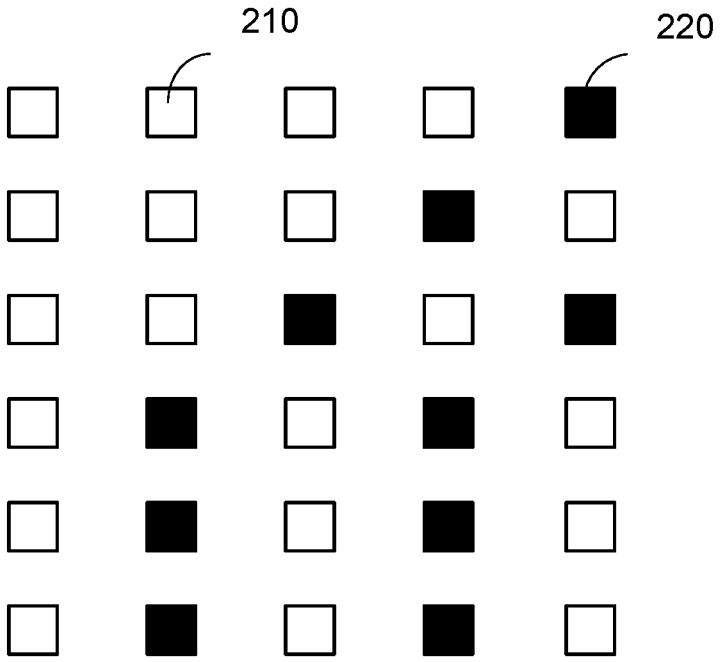
FIG. 5 illustrates a working principle of a second type of a traffic redirection device in a traffic redirection system according to some other embodiments of the present disclosure.

In a second embodiment of the present disclosure as illustrated in FIG. 5, a plurality of light sources, such as LED lamps 210, can be aligned in a matrix on a surface of the road and are configured to serve as the at least one traffic redirection device in the traffic redirection system. The bounds 220 of each of the traffic lanes can be marked by lights emitted from a subset of the plurality of light sources 210 in a configurable way. As such by altering the patterns of the light sources 210 that are turned on (i.e. the subset of the light sources), the traffic lanes on the road can be altered conveniently.

Regardless of the types of the traffic redirection device employed in the traffic redirection system, the traffic lanes on the road can be flexibly and readily altered by means of the at least one traffic redirection device. As such, when a congestion, such as the one caused by a traffic accident, occurs on the road, the at least one traffic redirection device allows an alteration of traffic lanes, which in turn can guide the vehicles to bypass the location of congestion, leading to a reduction of congestions on the road.

Specifically, in Step (101), upon congestion, at least one traffic redirection device and/or at least one electronic device can send congestion site information to a server. Such congestion site information may include coordinates of the location of congestion.

For example, a trigger button may be arranged on each of the at least one traffic redirection device. When a traffic accident happens, a person implicated in the traffic accident or a witness can trigger the trigger button on one traffic redirection device that is closest to him/her. Upon triggering, the traffic redirection device can send to the server a location of the traffic redirection device itself, which can be regarded as the congestion site information.

Alternatively, in some other embodiments, a camera can be arranged on each of the at least one traffic redirection device. When a camera captures that a traffic accident happens at a site in correspondence therewith, the traffic redirection device on which the camera is arranged can send to the server the congestion site information.

Alternatively, in yet some other embodiments, a person implicated in the traffic accident or a witness can send to the server the congestion site information by means of an electronic device he/she carries, such as a mobile phone.

It should be noted that these three embodiments as described above are only for purposes of illustration. Other embodiments are possible, and there are no limitations herein.

In step (102), the server obtains the congestion site information. In addition, the server can also obtain statuses of traffic lanes around the location of congestion.

For example, in some embodiments of the present disclosure, the server can store the data of all traffic lanes for a whole region or a whole city in advance. When the congestion site information is obtained, the server can then obtain statuses of traffic lanes around the location of congestion from data of all traffic lanes.

Alternatively, in some other embodiments of the present disclosure, the server can obtain the statuses of traffic lanes around the location of congestion by means of at least one camera that is disposed or arranged around the location of congestion. These cameras may be the same as those cameras described above as the traffic redirection devices, and may be different.

It should be noted that these three embodiments as described above are only for purposes of illustration. Other embodiments are possible, and there are no limitations herein.

In Step (103), the server determines the specific location of congestion based on the congestion site information. For example, the location of congestion can be a specific address, such as 102 Daqing Road in Xi'an, Shanxi Province, China.

A traffic accident or a car accident typically occupies part of the road (part of a traffic lane or part of several neighboring traffic lanes), and an extra space is typically needed during handling of the traffic accident. As such, in order to avoid the occurrence of further traffic accidents and to ensure personal safety of people implicated in the accident, the police, and the witnesses, the location of congestion needs to be separated.

As such, in Step (104), the server can determine a separation zone. The separation zone can be centered on the location of congestion and has a preset distance between each of the borderline of the separation zone and the center (i.e. location of congestion). For example, separation zone can be a square, having the preset distance of ~15 meters between each of the four borderlines and the location of congestion.

Furthermore, because different maximum speed limits may be set for different segments of the road, the size of the separation zone need to be arranged accordingly based on the maximum speed limit at the location of congestion. Typically, the size of the separation zone can be set to be proportional to the maximum speed limit at the location of congestion, i.e., the greater the maximum speed limit at the location of congestion, the greater the size of the separation zone.

This is because a change of lanes for a vehicle is typically more difficult at a higher speed. If the separation zone is too small, a driver may only figure that there is a need for him/her to change lanes when he/she approaches the separation zone at a very close location. As a result, the chance to trigger a secondary accident at the location of congestion is increased due to an untimely change of the lanes.

In Step (105), based on the separation zone determined above the server can adjust the traffic lanes to obtain a redirected traffic pattern, which comprises at least one adjusted traffic lanes. Each of the at least one adjusted traffic lane is configured to bypass the separation zone, and as such, vehicles can pass by the location of congestion, resulting in a reduction of traffic jams.

In one illustrating example, the statuses of traffic lanes around the location of congestion can include a status of a first lane, and a status of at least one second lane, wherein each of the at least one second lane is adjacent to the first lane, and the separation zone is on the first lane. It is noted that if the separation zone is on a border between two lanes, these two lanes together can be regarded as a first lane. As such, the redirected traffic pattern (i.e. the adjusted traffic lanes) determined by the server comprises one adjusted first lane and at least one adjusted second lane.

Figure 6:
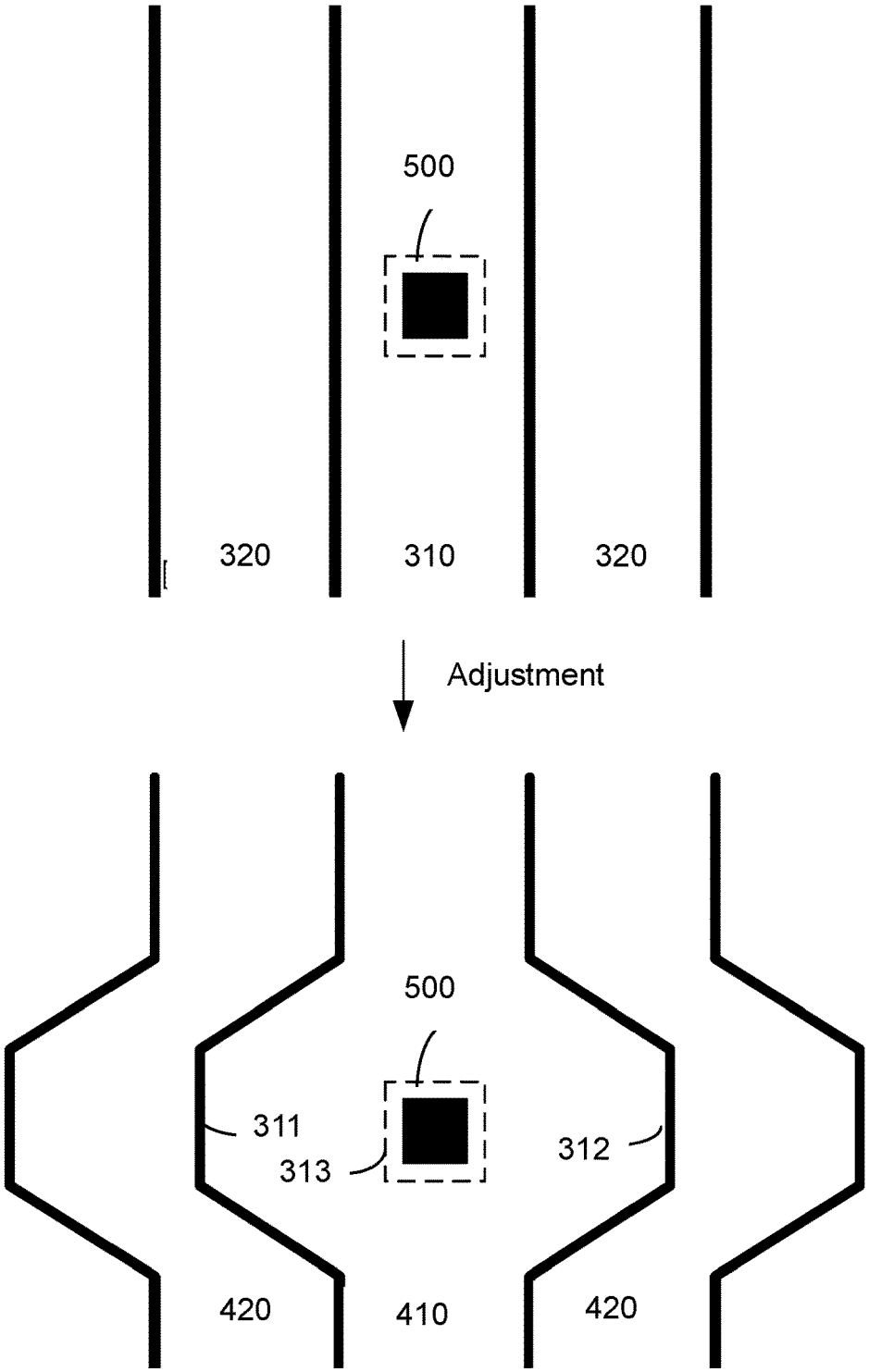
FIG. 6 illustrates a working principle whereby a server of a traffic redirection system redirects traffic lanes according to a first embodiment of the present disclosure.

FIG. 6 illustrates a working principle whereby a server of the traffic redirection system redirects traffic lanes according to a first embodiment of the present disclosure. As shown in FIG. 6, upon congestion occurs on the first lane 310, the server can increase a width of a segment of the first lane 310 corresponding to the separation zone 500 to thereby obtain an adjusted first lane 410. The adjusted first lane 410 is configured such that a distance between at least one sideline thereof and a corresponding sideline of the separation zone (i.e. the sideline of the separation zone 500 that is directly opposing to the sideline of the adjusted first lane 410) is at least a width of a traffic lane.

In the example as illustrated in FIG. 6, the adjusted first lane 410 comprises a first sideline 311 and a second sideline 312. The distance between the first sideline 311 and an opposing sideline 313 of the separation zone is equal to, or more than, a width of a traffic lane.

Herein the width of a traffic lane can be a width of the first lane or the second lane, or can be set based on real situation. For example, the width of a traffic lane can be set to be a little narrower than the first lane, as long as it allows a vehicle of an ordinary size to pass therethrough. There are no limitations herein. Furthermore, a traffic lane, a traffic lane, or a lane, refers to a single-direction traffic lane for a vehicle.

As such, the server can adjust the first lane 310 by increasing the width of the segment of the first lane 310 at the separation zone 300, such that at least one distance between each of the two sidelines of the separation zone 300 and the opposing sideline of the adjusted first lane 410 is at least a width of a traffic lane allowing for passing by of an ordinary vehicle. Consequently, at least one of the two side passageways next to the separation zone 500 can allow ordinary vehicles to pass therethrough without causing a traffic jam at and behind the separation zone 500.

Correspondingly for the at least one second lane 320 adjacent to the first lane 310, the server can adjust each of the at least one second lane 320 such that each of the at least one adjusted second lane 420 is substantially in parallel with the adjusted first lane 410, and that each of the at least one adjusted second lane 420 has a width substantially equal to, or a little less than, a width of a second lane 320 to allow a vehicle of an ordinary size to pass thereby. As such, the original traffic on the at least one second lane 320 is minimally affected. Herein the adjusted first lane 410 and the at least one adjusted second lane 420 together comprise the redirected traffic pattern after redirection or adjustment by the server.

If no second lanes are found in the statuses of traffic lanes around the location of congestion, i.e. the separation zone takes up all traffic lanes, there is no need to adjust a second lane to obtain the adjusted second lane.

Figure 7:
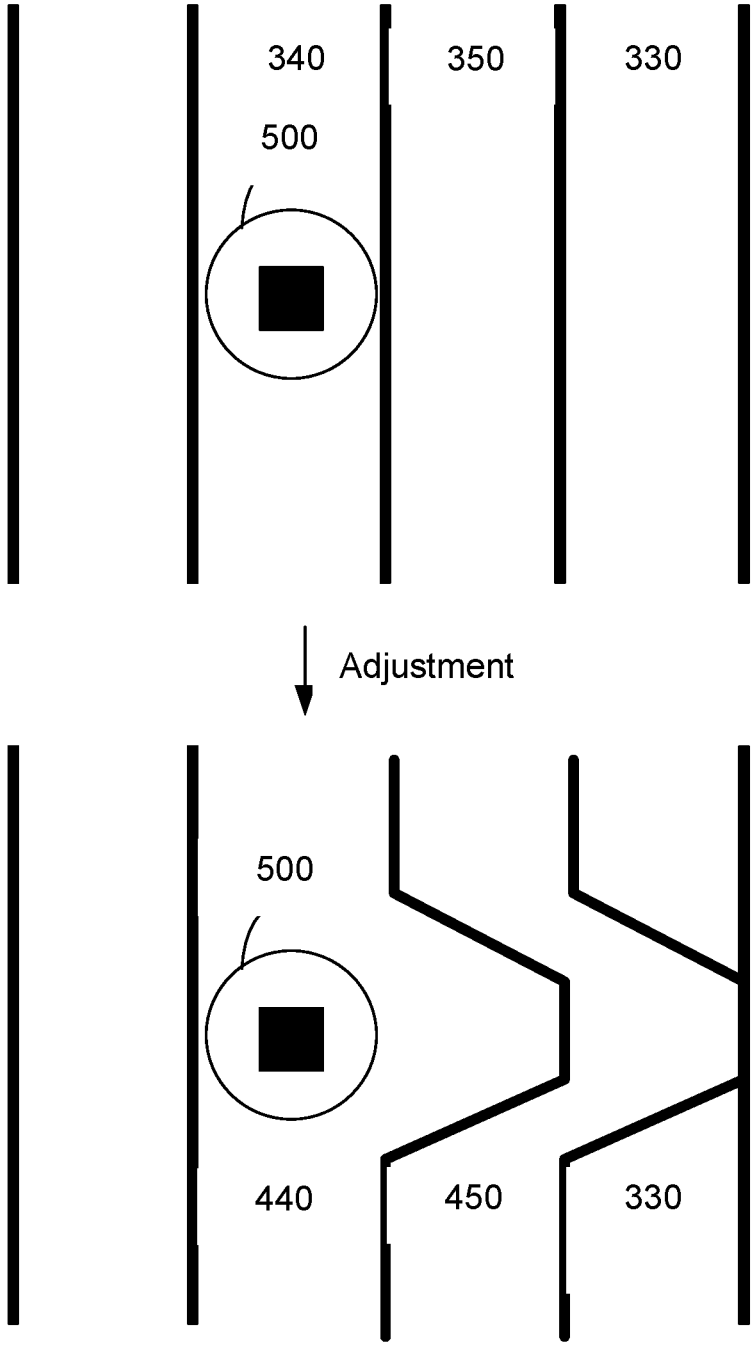
FIG. 7 illustrates a working principle whereby a server of a traffic redirection system redirects traffic lanes according to a second embodiment of the present disclosure.

Alternatively, if the statuses of traffic lanes around the location of congestion include information of an emergency lane 330, the server can rearrange the segment of the traffic lanes corresponding to the separation zone 500 as illustrated in FIG. 7.

Specifically, the separation zone 500 is on a third lane 340, and at least one fourth lane 350 is between the third lane 340 and the emergency lane 330. In the rearrangement of the traffic lanes by the server, an adjusted third lane 440 is widened on a section having the separation zone such that a sideline of the third lane between the separation zone 500 and the emergency lane 330 bends towards the emergency lane 330 to substantially allow an ordinary vehicle to pass by. Each of the at least one adjusted fourth lane 450 is adjusted from a corresponding fourth lane and is configured to substantially bend towards the emergency lane 330 to substantially allow an ordinary vehicle to pass by.

In the example as shown in FIG. 7, each of the adjusted traffic lanes is shifted for a distance of substantially a width of a traffic lane towards the emergency lane 330. In other words, the emergency lane 330 is utilized for generating the adjusted traffic lanes. When a vehicle passes by the separation zone 500 through one of the adjusted traffic lanes, it gets back onto the original traffic lane.

It is noted that these above two examples as respectively illustrated in FIGS. 6 and 7 represent only two embodiments of the present disclosure. It can be understood that based on a similar concept as exemplified by the two embodiments as described above, a person of ordinary skills in the field can design programs in the server in an appropriate way depending on practical situations to obtain adjusted traffic lanes each having a width substantially allowing a vehicle of an ordinary width to pass by the separation zone. There are no limitations herein.

After determining the redirected traffic pattern (i.e. the adjusted traffic lanes), in Step (106), the server generates a traffic redirection instruction and then sends the traffic redirection instruction to the at least one traffic redirection device for displaying the redirected traffic pattern on the road. With instructions from the redirected traffic pattern, a driver can conveniently pass by the location of congestion without causing further congestion at the separation zone.

In some embodiments of the present disclosure where the at least one traffic redirection device comprise a plurality of light sources as illustrated in FIG. 5, which are aligned in a matrix on the surface of the road, the server can instruct the plurality of light sources to display the redirected traffic pattern, such that a first subset of the light sources corresponding to both side of the adjusted traffic lanes receive an ON instruction whereas a second subset of the light sources other than the first subset of the light sources receive an OFF instruction.

As such, the first subset of the light sources are on an ON status and the second subset of the light sources are on an OFF status, to thereby mark the bounds of each of the redirected/adjusted traffic lanes to display the redirected traffic pattern at the location of congestion on the road.

In some other embodiments of the present disclosure where the at least one traffic redirection device comprise a plurality of projection lamps as illustrated in FIG. 4, which are arranged on at least one side of the road, the server can instruct the plurality of projection lamps to display the redirected traffic pattern. The server can determine an angle and a pattern for each projection lamp based on the distance between the adjusted traffic lanes and each projection lamp, and then the server can send a traffic redirection instruction comprising an instruction for the angle and an instruction for the pattern to each projection lamp.

Upon receiving the traffic redirection instruction, each projection lamp projects the light at the angle and of the pattern specified by the traffic redirection instruction transmitted by the server, which together mark the bounds of each of the redirected/adjusted traffic lanes to display the redirected traffic pattern at the location of congestion on the road.

In some other embodiments of the present disclosure where the at least one traffic redirection device comprise a plurality of traffic instruction displaying devices, such as electric road signs, the server can send the traffic redirection instruction to at least one traffic instruction displaying device disposed on a side of the redirected traffic lanes, and each of the at least one traffic instruction displaying device can then display the adjusted traffic lanes in the redirected traffic pattern.

As such, when a traffic accident occurs on a road, the traffic lanes can be adjusted by means of at least one traffic redirection device to thereby form a redirected traffic pattern comprising at least one adjusted traffic lane, and with the guidance of the redirected traffic pattern, the passing vehicles can smoothly bypass the location of congestion, thereby resulting in an effective reduction of traffic jams.

Figure 8:
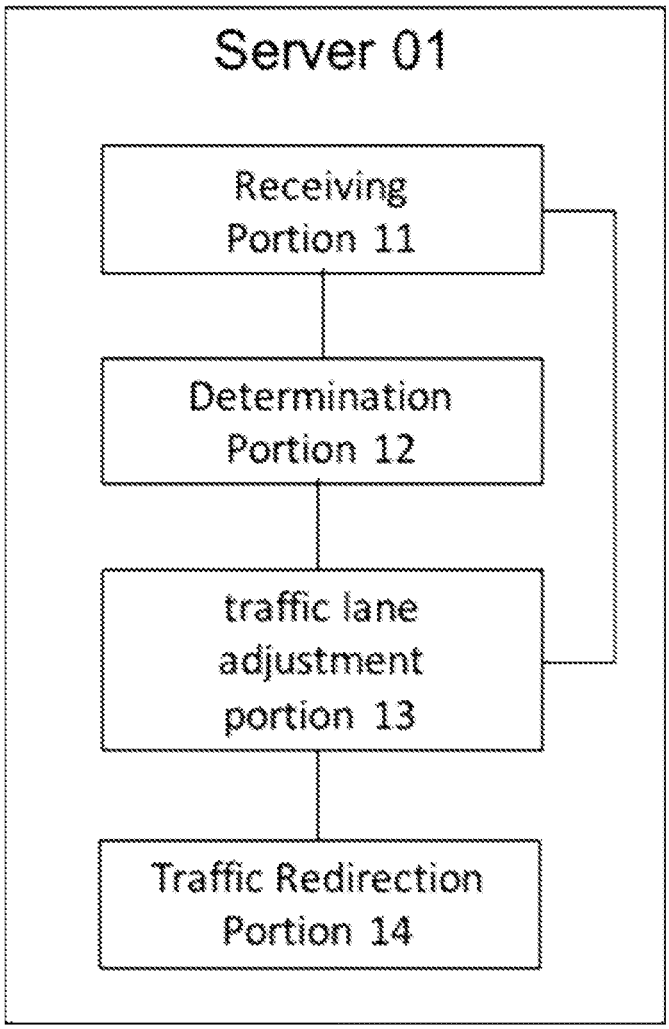
FIG. 8 is a schematic diagram of a server of a traffic redirection system according to some embodiments of the present disclosure.

FIG. 8 is a schematic diagram of a server of a traffic redirection system according to some embodiments of the present disclosure. It should be noted that the server 01 as illustrated in FIG. 8 can be applied in any of the embodiments as described above and as illustrated in FIGS. 1-7, and that for simplicity and convenience, FIG. 8 only illustrates the components that are commonly relevant to the various embodiments as shown in FIGS. 1-7. Other details are not repeated herein and can be referenced to the various embodiments as illustrated in FIGS. 1-7.

Specifically, the server 01 comprises:

A receiving portion 11, configured to receive congestion site information, including information about a location of congestion, and statuses of traffic lanes around the location of congestion;

A determination portion 12, configured to determine a separation zone for separating the location of congestion based on the location of congestion;

A traffic lane adjustment portion 13, configured to determine a redirected traffic pattern based on the separation zone to thereby adjust the traffic lanes to bypass the separation zone; and A traffic redirection portion 14, configured to generate a traffic redirection instruction based on the redirected traffic pattern, and to send the traffic redirection instruction to the above mentioned at least one traffic redirection device for displaying the redirected traffic pattern (i.e. the adjusted traffic lanes) on the road.

In some embodiments of the present disclosure, the statuses of traffic lanes around the location of congestion can include a status of a first lane, and a status of each of the at least one second lane, wherein each of the at least one second lane is adjacent to the first lane. The separation zone is on the first lane. The redirected traffic pattern (i.e. the adjusted traffic lanes) comprises one adjusted first lane and at least one adjusted second lane.

As such, the traffic lane adjustment portion 13 is configured to increase a width of the first lane at a segment corresponding to the location of congestion to thereby obtain an adjusted first lane, configured such that a distance between at least one sideline thereof and a corresponding sideline of the separation zone (i.e. the sideline of the separation zone that is directly opposing to the sideline of the adjusted first lane) is at least a width of a traffic lane. Based on the width of the second lane(s), each of the at least one second lanes are adjusted to be substantially in parallel with, and next to, the adjusted first lane to thereby obtain the at least one adjusted second lane.

In some other embodiments of the present disclosure, the statuses of traffic lanes around the location of congestion further includes a status of an emergency lane. As such, the traffic lane adjustment portion 13 is configured to rearrange the segment of the traffic lanes corresponding to the separation zone between the separation zone and the emergency lane, such that each of the adjusted traffic lanes gets widened towards, and thereby bends towards, the emergency lane to thereby obtain the redirected traffic pattern.

In some embodiments of the present disclosure, the receiving portion 11 can be configured to receive the congestion site information from at least one traffic redirection device disposed at around the location of congestion. In some other embodiments, the receiving portion 11 can be configured to receive the congestion site information from at least one electronic device. In yet some other embodiments, the receiving portion 11 can be configured to receive the congestion site information from at least one traffic redirection device disposed at around the location of congestion and at least one electronic device.

The determination portion 12 is configured to determine the location of congestion based on the congestion site information, and then to determine the separation zone for separating the location of congestion from the traffic based on the location of congestion. The separation zone is set to be centered on the location of congestion, and have a preset distance between each of the borderline of the separation zone and the center (i.e. location of congestion). The size of the separation zone is set to be proportional to the maximum speed limit at the location of congestion.

Figure 9:
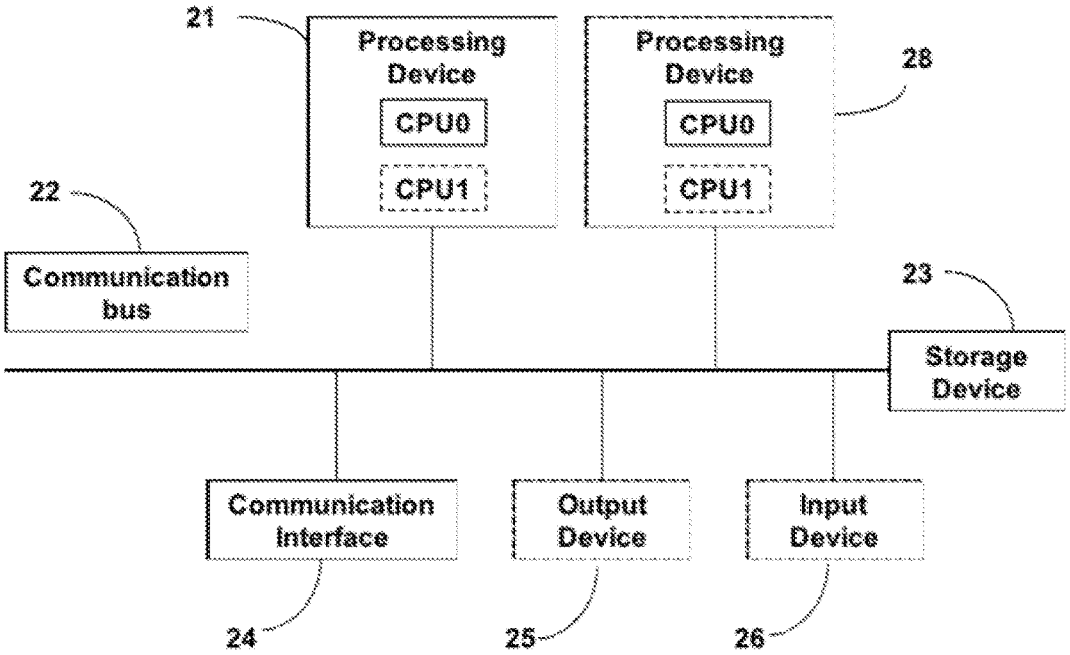
FIG. 9 is a schematic diagram of a computer subsystem of a traffic redirection system according to some embodiments of the present disclosure.

As an illustrating example, the server 100 can be a computer (or a computer subsystem) as illustrated in FIG. 9.

FIG. 9 illustrates one computer subsystem in a traffic redirection system according to some embodiments of the present disclosure. The computer subsystem 200 comprise a processing device 21, a communication bus 22, a storage device 23, and at least one communication interface 24.

Herein the processing device 21 can be one or more devices, circuits, and/or processors that specifically process programs or instructions. As such, the processing device 21 can comprise a central processing unit (CPU), a microprocessor, an application-specific integrated circuit (ASIC), an integrated circuit specifically for controlling the processing of the programs involved in the present disclosure.

In some embodiments, the processing device 21 of the computer subsystem 200 can include one or more processing sub-devices. In one example as illustrated in FIG. 9, the computer subsystem 200 comprises two processing sub-devices 21 and 28. Each of the processing sub-devices can include a single-core processor, or a multi-core processor. In the embodiment as illustrated in FIG. 9, each of the processing sub-devices 21 and 28 include two CPUs, CPU0 and CPU1, respectively. Other embodiments having different type, number, and combination of the processing sub-device are also possible, and there are no limitations herein.

The communication bus 22 comprises a bus through which the processing device 21, the storage device 23, the at least one communication interface 24, and other connecting devices communicate with one another.

Each of the at least one communication interface 24 comprises any types of a transceiver, and is configured to communicate with a communication network, including an Ethernet, a radio access network (RAN), or a wireless local area network (WLAN), etc., or other devices.

The storage device 23 is configured to store application codes of programs in the present disclosure, and is configured to be controlled by the processing device 21. The processing device 21 is configured to execute the application codes stored in the storage device 23.

The storage device 23 can comprise a read-only memory (ROM) or another type of a static storage device capable of statically storing information or instructions. The storage device 23 can also comprise a random access memory (RAM) or another type of a dynamic storage device capable of dynamically storing static information or instructions. The storage device 23 can also comprise an electrically erasable programmable read-only memory (EEPROM), a compact disc read-only memory (CD-ROM) or another type of an optical disc storage device (for example, Compact disc, CD, DVD, digital versatile disc, Blu-ray Disc, etc.), a magnetic disk storage medium or another type of a magnetic storage device, or another type of a storage medium capable of carrying or storing desired programs comprising instructions or data structure and capable of being accessed to by a computer. There are no limitations herein.

The storage device 23 can be an independent device coupled with the processing device 21 via the communication bus 22, or can be integrated with the processing device 21. There are no limitations herein.

In real practice, some embodiments of the computer subsystem 200 can further include an output device 25, and an input device 26.

Herein the output device 25 is configured to communicate with the at least one processor 21, and is configured to display information through at least one outputting approach. For example, the output device 25 can be a liquid crystal display (LCD), a light emitting diode (LED) display, a cathode ray tube (CRT) display, or a projector, and can be other types of a displaying apparatus. There are no limitations herein.

Herein the input device 26 is configured to communicate with the at least one processor 21, and is configured to receive inputs from a user through at least one inputting approach. For example, the input device 26 can be a mouse, a keyboard, a touch-control display apparatus, or a sensor. There are no limitations herein.

The computer subsystem 200 can be a general computer or a computer having specific applications. In real practice, the computer subsystem 200 can be a desktop computer, a mobile computer, a network computer, a personal digital assistant (PDA) computer, a mobile phone, a flat panel computer, a wireless terminal device, a communication device, an embedded device, or an equipment of a structure similar to that as illustrated in FIG. 9. There are no limitations herein.

Taken above together, the present disclosure provides a system and a method for redirecting traffic (i.e. adjusting traffic lanes) on the road after a traffic accident occurs. The system includes a server and at least one traffic redirection device coupled to the server.

The server can obtain information about the congestion site and information about the traffic (i.e. statuses of traffic lanes) around the congestion site. Next the server can determine a location of congestion, and a separation zone. Then based on the separation zone, the server can determine a redirected traffic pattern comprising at least one adjusted traffic lane, which is configured to redirect or adjust the traffic lanes to bypass the separation zone. Finally, the server can generate, and send to the at least one traffic redirection device, a traffic redirection instruction, whereby the at least one traffic redirection device can display the redirected traffic pattern (i.e. adjusted traffic lanes) at the location of congestion.

As a consequence, vehicles can move following the redirected traffic pattern to thereby bypass the separation zone and the location of congestion, realizing an intelligent traffic redirection and leading to an effective relief of the issue of traffic accident-induced road congestion.

All references cited in the present disclosure are incorporated by reference in their entirety. Although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the exemplary embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

The invention claimed is:

1. A system for redirecting traffic on a road, comprising:

a server; and at least one traffic redirection device, each disposed along the road and coupled with the server;

wherein:

the server is configured to receive congestion site information if a congestion occurs on the road, to determine a separation zone covering a location of congestion based on the congestion site information, to determine a redirected traffic pattern, and to send a traffic redirection instruction to the at least one traffic redirection device; and the at least one traffic redirection device is configured to respond to the traffic redirection instruction, such that the at least one traffic redirection device together displays the redirected traffic pattern on the road to thereby guide vehicles to bypass the separation zone.

2. The system according to claim 1, wherein:

the road comprises at least one traffic lane;

the congestion site information comprises a status of each of the at least one traffic lane around the location of congestion; and the redirected traffic pattern comprises at least one adjusted traffic lane, wherein each of the at least one adjusted traffic lane is adjusted from a corresponding traffic lane and configured to bypass the separation zone.

3. The system according to claim 2, wherein:

the at least one traffic lane comprises a first lane and at least one second lane, wherein the congestion occurs on the first lane, and each of the at least one second lane is adjacent to the first lane;

the redirected traffic pattern comprises:

an adjusted first lane, adjusted on a section of the first lane having the separation zone and configured such that a distance between at least one sideline thereof and an opposing sideline of the separation zone is at least a width substantially allowing an ordinary vehicle to pass by; and at least one adjusted second lane, each adjusted from a corresponding second lane and configured to be substantially in parallel with the adjusted first lane and have a width substantially allowing an ordinary vehicle to pass by.

4. The system according to claim 2, wherein:

the road further comprises an emergency lane, and the at least one traffic lane comprises a third lane and at least one fourth lane, wherein the congestion occurs on the third lane, and the at least one fourth lane is between the third lane and the emergency lane;

the congestion site information further comprises a status of the emergency lane around the location of congestion; and the redirected traffic pattern comprises:

an adjusted third lane, widened on a section of the third lane having the separation zone such that a sideline thereof between the separation zone and the emergency lane bends towards the emergency lane to substantially allow an ordinary vehicle to pass by; and at least one adjusted fourth lane, each adjusted from a corresponding fourth lane and configured to substantially bend towards the emergency lane to substantially allow an ordinary vehicle to pass by.

5. The system according to claim 2, wherein:

the at least one traffic redirection device comprises a plurality of light sources including light-emitting diode (LED) lights, disposed over a surface of the road, arranged in a matrix and each configured to switch on or off under control of the server;

the traffic redirection instruction comprises an ON signal or an OFF signal for respectively controlling turning-on or turning-off of each of a subset of the plurality of light sources around the location of congestion; and the each of the subset of the plurality of light sources is configured to switch on or off upon receiving the traffic redirection instruction from the server, such that the subset of the plurality of light sources together mark bounds of each of the at least one adjusted traffic lane to thereby display the redirected traffic pattern on the road.

6. The system according to claim 2, wherein:

the at least one traffic redirection device comprises a plurality of projection lamps, disposed along the road and each configured to project a light onto a surface of the road under control of the server;

the traffic redirection instruction comprises a first specification for an angle and a second specification for a pattern for each of a subset of the plurality of projection lamps around the location of congestion; and the each of the subset of the plurality of projection lamps is configured to project a light at the angle and the pattern specified by the traffic redirection instruction, such that the subset of the plurality of projection lamps together mark bounds of each of the at least one adjusted traffic lane to thereby display the redirected traffic pattern on the road.

7. The system according to claim 2, wherein:

the at least one traffic redirection device comprises a plurality of traffic instruction displaying devices, disposed along the road;

the traffic redirection instruction comprises information of the redirected traffic pattern and is configured to be sent to each of a subset of the plurality of traffic instruction displaying devices around the location of congestion; and the each of the subset of the plurality of traffic instruction displaying devices is configured to display the information of the redirected traffic pattern.

8. The system according to claim 1, further comprising at least one congestion site notification device, wherein:

each of the at least one congestion site notification device is coupled with the server and is configured to notify the server of a location of the each of the at least one congestion site notification device upon triggering by a person close to the location of congestion; and the congestion site information received by the server comprises the location of the each of the at least one congestion site notification device.

9. The system according to claim 8, wherein the at least one congestion site notification device comprises at least one of:

a triggering device, disposed along the road and configured to send to the server a location of the triggering device upon triggering; or an electronic device, configured to send to the server a location of the electronic device upon triggering.

10. The system according to claim 9, wherein the at least one congestion site notification device comprises a triggering device, disposed on one of the at least one traffic redirection device and configured to send to the server a location of the one of the at least one traffic redirection device upon triggering.

11. The system according to claim 9, wherein the at least one congestion site notification device comprises an electronic device, wherein the electronic device is a mobile phone, a vehicle-mounted device, or a computer.

12. The system according to claim 8, further comprising at least one camera, disposed along the road, wherein:

each of the at least one camera is coupled with the server, and is configured to notify the server of a status of traffic around the location of congestion upon activation by the server receiving the congestion site information; and the congestion site information further comprises the status of traffic around the location of congestion.

13. The system according to claim 12, wherein the server is configured to determine the separation zone based on the status of traffic around the location of congestion.

14. The system according to claim 1, wherein the server is configured to determine the separation zone further based on a maximum speed limit at the location of congestion on the road, wherein a size of the separation zone is configured to be proportional to the maximum speed limit at the location of congestion on the road.

15. The system according to claim 1, wherein the server comprises:

a receiving portion, configured to receive the congestion site information if a congestion occurs on the road;

a determination portion, configured to determine the separation zone comprising the location of congestion based on the congestion site information;

a traffic lane adjustment portion, configured to determine the redirected traffic pattern based on the separation zone; and a traffic redirection portion, configured to generate, and to send to each of the subset of the at least one traffic redirection device around the location of congestion, the traffic redirection instruction based on the redirected traffic pattern.

16. The system according to claim 1, wherein the server is a cloud server, a surveillance server, or a remote controller.

17. A method for redirecting traffic on a road by means of a traffic redirection system according to claim 1, comprising:

the server receiving congestion site information if a congestion occurs on the road;

the server determining a separation zone covering a location of congestion based on the congestion site information;

the server determining a redirected traffic pattern based on the separation zone;

the server generating a traffic redirection instruction based on the redirected traffic pattern and sending the redirected traffic pattern to the at least one traffic redirection device; and the at least one traffic redirection device displaying the redirected traffic pattern on the road to thereby guide vehicles to bypass the separation zone.

18. The method of claim 17, wherein: the server receiving congestion site information if a congestion occurs on the road comprises:

one of at least one congestion site notification device disposed along the road notifying the server of a location of the one of the at least one congestion site notification device upon triggering by a person close to the location of congestion, wherein the congestion site information received by the server comprises the location of the each of the at least one congestion site notification device.

19. The method of claim 18, wherein: the server receiving congestion site information if a congestion occurs on the road further comprises, after one of at least one congestion site notification device notifying the server of a location of the one of the at least one congestion site notification device upon triggering by a person close to the location of congestion:

one of at least one camera disposed along the road notifying the server of a status of traffic around the location of congestion upon activation by the server receiving the location of the one of the at least one congestion site notification device, wherein the congestion site information further comprises the status of traffic around the location of congestion.

20. The method of claim 17, wherein the separation zone is determined further based on a maximum speed limit at the location of congestion on the road, such that a size of the separation zone is configured to be proportional to the maximum speed limit at the location of congestion.

* * * * *